US006834844B1

(12) United States Patent
Hamada et al.

(10) Patent No.: US 6,834,844 B1
(45) Date of Patent: Dec. 28, 2004

(54) ELECTROMAGNETIC TYPE FUEL INJECTOR VALVE

(75) Inventors: Yasunaga Hamada, Hitachinaka (JP); Yasuo Namaizawa, Ishioka (JP)

(73) Assignees: Hitachi, Ltd., Tokyo (JP); Hitachi Car Engineering Co., Ltd., Hitachinaka (JP)

( * ) Notice: Subject to any disclaimer, the term of this patent is extended or adjusted under 35 U.S.C. 154(b) by 0 days.

(21) Appl. No.: 09/763,971

(22) PCT Filed: Mar. 8, 2000

(86) PCT No.: PCT/JP00/01393

§ 371 (c)(1),
(2), (4) Date: Sep. 13, 2001

(87) PCT Pub. No.: WO01/66933

PCT Pub. Date: Sep. 13, 2001

(51) Int. Cl.[7] ..... F02M 51/06; F16K 31/02

(52) U.S. Cl. ..... 251/129.1; 251/129.21; 123/490; 239/585.4; 335/256

(58) Field of Search ..... 251/129.09, 129.1, 251/129.21; 123/490; 239/585.4; 335/256, 266

(56) References Cited

U.S. PATENT DOCUMENTS

| | | | | | |
|---|---|---|---|---|---|
| 4,078,528 | A | * | 3/1978 | Hoshi | 123/490 |
| 4,154,198 | A | * | 5/1979 | Hoshi | 123/490 |
| 4,785,848 | A | * | 11/1988 | Leiber | 137/596.17 |
| 4,944,486 | A | * | 7/1990 | Babitzka | 251/129.21 |
| 5,275,341 | A | * | 1/1994 | Romann et al. | 239/585.4 |
| 5,992,391 | A | * | 11/1999 | Yamakado et al. | 123/490 |
| 6,130,279 | A | * | 10/2000 | Suzuki et al. | 524/401 |

FOREIGN PATENT DOCUMENTS

| | | | | |
|---|---|---|---|---|
| DE | 19828672 A1 | * | 1/1999 | F02M/51/06 |
| GB | 1427995 | | 3/1976 | |
| JP | 62225760 | * | 10/1987 | F02M/51/06 |
| JP | 4-198266 | | 7/1992 | |
| JP | 7-42648 | | 2/1995 | |
| JP | 9-115726 | | 5/1997 | |
| JP | 10-89518 | | 4/1998 | |
| JP | WO98/16585 | * | 4/1998 | C08L/81/02 |
| JP | 10-293940 | | 11/1998 | |
| WO | WO 91/11611 | | 8/1991 | |

OTHER PUBLICATIONS

Microfilm of the specification and drawings annexed to the request of Japanese Utility Model Application No. 142730, Apr. 20, 1982, pp. 2–4.

* cited by examiner

*Primary Examiner*—Eric Keasel
(74) *Attorney, Agent, or Firm*—Crowell & Moring LLP

(57) ABSTRACT

An electromagnetic fuel injector of an internal combustion engine having a plurality of electromagnetic coils for valve driving wound separately on a bobbin in an axial direction. The bobbin has a step difference of the outer diameter so that the bobbin outer diameter in the region with the second coil to be wound thereon is smaller then the bobbin outer diameter in the region with the first coil to be wound thereon, and the bobbin inner diameter has a step difference in that the bobbin inner diameter in the region with the first coil to be wound thereon is made large partially so as to secure an annular space to interpose a seal ring therein.

6 Claims, 10 Drawing Sheets

ELECTROMAGNETIC TYPE FUEL INJECTOR VALVE

BACKGROUND OF THE INVENTION

1. Field of the Invention

The present invention relates to an electromagnetic fuel injector for an internal combustion engine.

2. Description of Related Art

In an electromagnetic fuel injection valve (sometimes called an injection valve), opening and closing operation is performed by controlling an electromagnetic coil in energizing with current and interrupting, and while the valve is opened, a fuel is injected to a intake air passage, a intake port or a combustion chamber.

As such an injector, a system is put to practical use, where in order to improve rising characteristics while a valve is opened, high voltage is produced by providing a drive circuit with a booster circuit, and while the high voltage is impressed to a coil of the injector, a current control circuit is used and a large current is forced to flow at a short time (for example, JP-A 6-241137). In the system, a battery voltage (for example, 12V) is raised (for example, 70V) during the valve opening. Particularly, as, an applied injector, there is an injector in intracylinder injection system where a fuel pressure is high and a load in a return spring is large (an injector where a fuel is injected directly into a combustion chamber of a gasoline engine).

In an injector using a booster circuit, when a valve is opened as already described, while a large voltage is impressed to an electromagnetic coil, a large current flows in the coil.

After the valve is opened, since a fuel pressure within the injector decreases and a return spring is not in the state of set load, force for holding the opened valve does not require magnetomotive force in comparison with the case of opening the valve. Accordingly while the opened valve is held, the voltage to the coil is changed from the booster circuit into the battery voltage, and in the coil a relatively small current enough to hold the opened valve is flowed by using a current control circuit.

Further in recent years, technology is proposed where a booster circuit is not used and rising characteristics during the valve opening are improved by a system impressing a battery (for example, JP-A 11-148439). In this system, two types of electromagnetic coils different in wire diameter and the number of turns of the coils are prepared. Among these, the first coil is mainly used during the rising operation while the valve is opened (the operation that the valve moves from the closed position to the fully opened position), and as characteristics, time variation rate of the magnetomotive force is made large. Therefore in the first coil, the wire diameter is made relatively large (the coil resistance is made small), and the number of turns is made small and a large current flows in the coil with good response. Also since the current is made large, the magnetomotive force is raised.

The second coil is mainly used to hold the state after the valve is opened. Accordingly the response property as in the case of the first coil is not required, and the large magnetomotive force as in the case of opening the valve is not required. The time variation rate of the magnetomotive force may be small. Accordingly in the second coil, the wire diameter is made relatively small (the coil resistance is made large) and the number of turns is made large, and the magnetomotive force capable of holding the opened valve even at a small current is obtained.

In the battery voltage drive system, a booster circuit and a current control circuit as above described are not required. Accordingly the system is advantageous in that the cost reduction can be intended.

As above described, in the electromagnetic fuel injector valve, in order to raise the output characteristics and the response property, proposals are made and that the coil impressed voltage is raised and the coil current is made large, or two types of the electromagnetic coils different in the characteristics are used. With accompanying this, the countermeasure for heat generated in the coil is further required. Particularly an intense heat of the coil under the violent state of the high temperature circumstances such as the inside of the engine room deteriorates the state of the insulation film and the bobbin of the coil and results in the reduction of the life. Accordingly the countermeasure for the intense heat generated in the coil is necessary.

Besides the countermeasure for the intense heat, when the first coil and the second coil different in the characteristics are prepared as above described, the number of the coil terminals increases. Therefore the problems remain in that how these terminals and other parts are made intensive and rationalized and the injector is realized at compact structure and low cost.

SUMMARY OF THE INVENTION

An object of the present invention is to provide an injector in which these problems are solved and the heat radiation property of the coil of the injector accompanied by the performance improvement is raised, and which can entirely withstand the environment of the intense heat and assures its long life and moreover can intend to achieve the compact structure and the cost reduction.

In order to attain the foregoing object, the present invention is basically constituted as follows.

One is an injector with an electromagnetic coil for driving a valve, considering the heat radiation performance of the coil, where a bobbin for winding the coil thereon is constituted by a synthetic resin containing a filler having good heat conductivity.

Another is an injector where an electromagnetic coil for driving a valve is provided with two types of coils different in the characteristics, and these coils are wound separately in the axial direction of one bobbin, and among these coils, the winding region of one coil (the first coil) is near a movable core with a valve element being the object of the magnetic suction and the winding region of the other coil (the second coil) is away from the movable coil, and where the bobbin has a step difference of the outer diameter so that the bobbin outer diameter in the region with the second coil to be wound thereon is smaller than the bobbin outer diameter in the region with the first coil to be wound thereon, and on the other hand, the bobbin inner diameter in the region with the first coil to be wound thereon is partially enlarged and the step difference of the inner diameter is formed so that the annular space to interpose the seal ring is secured.

Another is an injector having a first coil and a second coil different in characteristics as above described in order to intend simplification and rationalization of parts, where a connector part comprising three terminals is provided, and the above-mentioned first and second coils are connected to the power source and two switching elements for energizing control through the three terminals.

In order that electromagnetic coil relevant parts are made intensive and compact, another injector is constituted as follows.

That is, in an electromagnetic fuel injector where a first coil and a second coil as above described are arranged in the axial direction of one bobbin, and a connector part to connect terminals of these coils to an external power source and a switching elements is provided to project laterally at the upper side of the bobbin as above described, characterized in that plural terminals of said first and second coils are arranged on the upper end surface of said bobbin, and at least one of these terminals has the base part positioned at the opposite side of the connector part with respect to the axial line of the main body of the injector, and this terminal has a curved part formed at the midway led from the base part to the connector part so as to avoid the axial line.

DESCRIPTION OF THE PREFFRRED EMBODIMENTS

Figure 1A:
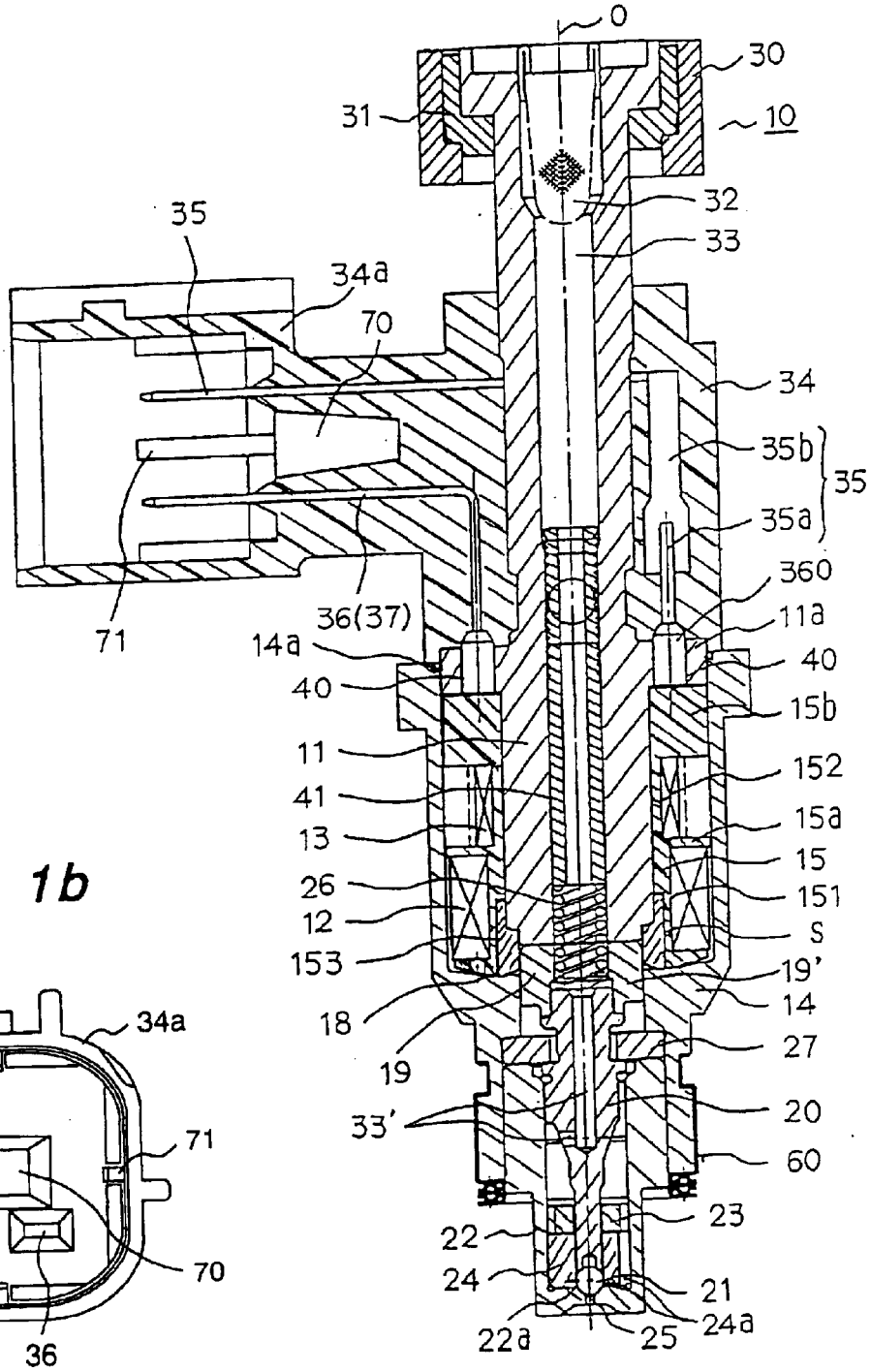
FIG. 1(*a*) is a longitudinal sectional view of an injector according to an embodiment of the invention, and (b) is a front view of a connector part of the injector.

An embodiment of the present invention will be described based on the drawings.

At first, the structure of an injector 10 in the embodiment will be described using FIG. 1.

The injector 10 is constituted by a stationary core 11, electromagnetic coils 12, 13, a yoke 14, a movable unit (also referred to as a movable core, a plunger or the like) 19 having a valve element 21, a nozzle 22, a return spring 26, an external resin mold 34 with a connector 34*a* and the like.

The movable unit 19 in this embodiment comprises a cylindrical movable core 19' having magnetism and a valve rod 20 coupled integrally.

In the inside of the cylindrical yoke 14 being a body of the injector, the stationary core (center core) 11, and the first coil 12 and the second coil 13 wound on a bobbin 15 are arranged from the center position toward the outside. The structure of the bobbin 15 and details of the coils 12, 13 will be described later.

The stationary core 11 is formed in a slender hollow cylinder, and the hollow part is a fuel passage 33. A part of the core 11 is positioned at the center within the yoke 14, and the other part is projected upward from the yoke 14. At the outer circumferential part of the core 11, a flange 11*a* is molded integral with the core 11. In the flange 11*a*, terminal holes 40 are arranged so that a plurality of coil terminals 35–37 provided on the bobbin 15 are inserted therethrough. The flange 11*a* is fitted to the upper opening of the yoke 14, and presses the inner circumferential edge of the yoke 14 locally and produces a metal flow (plastic flow). Thus the flange 11*a* is tightly coupled with the yoke 14. Numeral 14*a* in FIG. 1 designates trace of the metal flow.

The movable unit 19 is coupled integral with the spherical valve element 21, and is arranged in line with the core 11 in the axial direction. The return spring 26 is located between a spring adjuster 41 fixed within the hollow cylinder of the core 11 and a spring shoe within the movable unit 19, and applies a spring load in the valve opening direction to the movable unit 19. By the spring load, when the electromagnetic coils 12, 13 are not energized with a current, the valve element 21 is pushed to a sheet 22*a* provided at the nozzle 22 and closes an injection port 25.

When the electromagnetic coil is energized with current, a magnetic path is formed by the yoke 14, the stationary core 11 and the movable core 19', and the movable unit 19 is subjected to the magnetic suction toward the side of the core 11 and the valve element 21 is separated from the seat 22*a* and becomes the valve opened state. The stroke in the valve opening direction is restricted in that a part of the movable unit 19 (for example, the valve rod 20) abuts on a stopper 27.

During the valve opening, a pressurized fuel passes through a filter 32, a passage 33 and a passage 33' provided at the side of the movable unit and passes from the inside of the nozzle 22 through a groove 24*a* formed along from the side to the bottom in a swirler (a fuel swirling element) 24, and then it is swirled and injected from the groove between the valve element 21 and the seat 22*a*. The output side of the groove 24*a* is opened to the inner circumferential surface of the swirler 24 so as to be shifted to the tangential direction with respect to the swirler center axis. Thus the fuel swirls and flows out from the groove 24*a* to the swirler center hole.

As an example of the injector according to the embodiment, that of direct injection system is exemplified where the injection port 25 faces the inside of the cylinder (combustion chamber) of the internal combustion engine and the high pressure fuel is injected directly into the cylinder. The electromagnetic coil is constituted by a first coil (referred to as "valve opening coil" here) 12 to be used mainly during the valve opening so as to raise the valve element 21 from the seat position to the predetermined opening stroke position (the opening stroke is restricted by the stopper 27, and the opening stroke operation is referred to as "valve opening operation"), and a second coil (referred to as "holding coil" here) 13 to be used to hold the subsequent valve opening state.

In the direct injection system, since the injector is opened and closed in the combustion chamber, during the valve closing, the valve must be made not opened by the pressure during the explosion process. Also during the valve closing, the fuel must be injected into the high-pressure atmosphere in the compression process. Accordingly, in comparison with the system that the fuel is injected to the suction passage, the large return spring set load and the high fuel pressure are required. During the valve opening operation, the rising characteristics are required in that the magnetic suction force (magnetomotive force) to exceed the fuel pressure and the set load is generated with good response.

In order to obtain such rising characteristics during the valve opening, there are two systems as follows. One is a system that a large voltage (for example, about 70V) is impressed to an electromagnetic coil using a booster circuit, and a large current (for example, about 8 A) is let flow in the coil using a current control circuit in a short time. Another is a system that a booster circuit and a current control circuit are not used, but the number of turns is made relatively little and wire diameter of a coil is made large (coil resistance is made small) and a battery voltage is impressed to the coil directly. Therefore a large current is let flow in the coil in a short time.

In this embodiment, the latter system (so-called battery voltage impressing system) is adopted. The coil with the coil wire diameter being large and the number of turns being relatively little corresponds to the valve opening unit 12. The time variation rate of the magnetomotive force is large. The specific mode of the coil wire diameter, the number of turns or the like will be described later.

When the opened valve is to be held, since the fuel is already injected, the fuel pressure is decreased and the air gap between the movable unit 19 and the core 11 becomes small. Accordingly in the operation of holding the opened valve, the movable unit 19 can be held to the open state in smaller magnetomotive force than that during the valve opening operation.

In the opening valve holding state, in the system of the embodiment (battery voltage impressing system), the holding coil 13 having the coil wire diameter less than that of the valve opening coil 12 (coil 13 is large resistance) and the number of turns being relatively much is impressed by the battery voltage (in this case, the holding coil 12 and the valve opening coil 13 may be connected in series and both coils may be energized with current, and in the embodiment, such manner is done as described later). Thus the current flowing in the electromagnetic coil is decreased to the valve enough for the magnetomotive force to hold the opened valve (for example, about 3 A). In addition, in the system using the booster circuit as above described, in the opened valve holding state, the coil impressed voltage is changed to the battery voltage and the coil current is made small using the current control circuit.

Figure 5A:
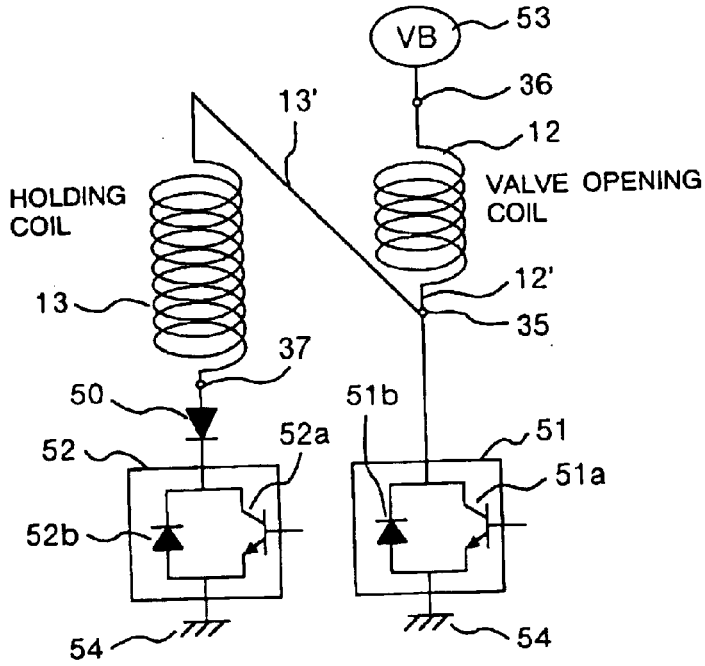
FIG. 5 is a drive circuit constitution diagram of an electromagnetic coil in the embodiment.
Figure 5B:
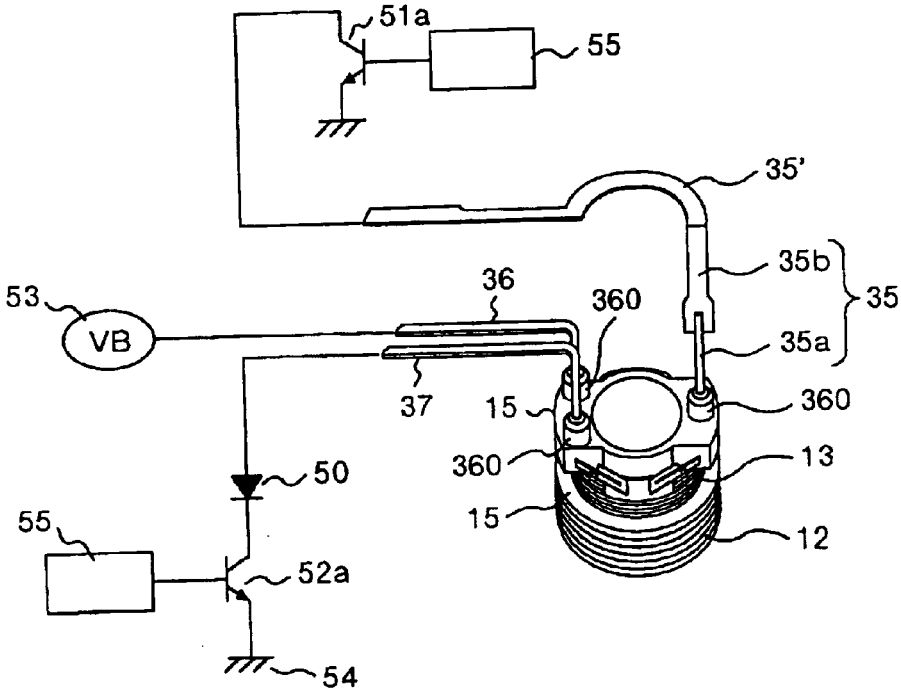
Figure 6:
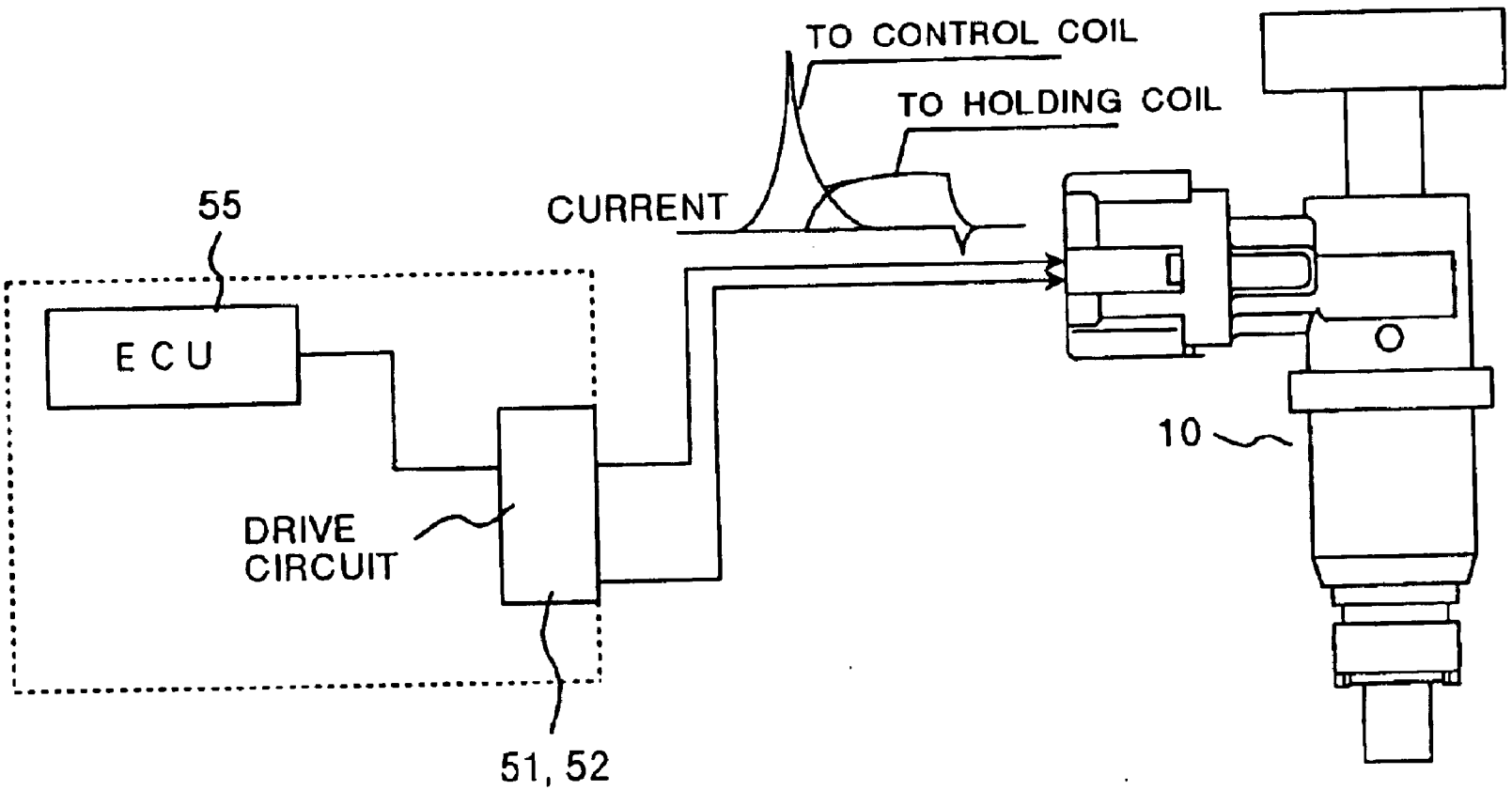
FIG. 6 is an explanation diagram showing a state that a valve opening signal is sent from an engine control unit to an injector.

Hereupon, the connection structure of the valve opening coil 12 and the holding coil 13 and relation to the coil drive circuit as above described by FIGS. 5 and 6.

In the embodiment, basically, a connector part 34*a* comprising three terminals (a first terminal 36, a second terminal 35, a third terminal 37) is provided as shown in FIG. 1 and FIGS. 3 to 5. By the three terminals, the valve opening coil (first coil) 12 and the holding coil (second coil) 13 are connected to a battery power source 53 and two switching elements 51*a*, 51*b* for energizing control as shown in FIG. 5.

The terminal 36 connects one end of the valve opening coil 12 to the plus side of the battery power source 53, and the terminal 35 connects the other end of the valve opening coil 12 to a switching element 51*a* for valve opening and also to one end of the holding coil 13, and the terminal 37 connects the other end of the holding coil 13 to the switching element 52*a* for the opened valve holding.

In the above-mentioned constitution, the terminal 35 is the terminal to connect the valve opening coil 12 to the switching element 51*a*, and also serves as an intermediate terminal to connect the valve opening coil 12 and the holding coil 13 in series connection state (when the switching element 51*a* is turned off and the switching element 52*b* is turned on the coils 12 and 13 become series connection state). Accordingly terminals of two types of coils different in the characteristics need not be made four terminals in total, and the reduction of the number of parts can be intended.

In addition, in the embodiment, one end (minus side) of the holding coil 13 is connected through a diode 50 to the switching element 52*a*.

These coils 12, 13 are in the same direction in the wire winding direction, and both coils are added to each other in the magnetomtive force for a current flowing in the same direction. In the switching elements 51*a*, 52*a*, for example, a semiconductor switching element such as a power transistor may be used.

The drive circuits 51, 52 are constituted by transistor module provided with the switching elements 51*a*, 52*a* and the surge absorbing diodes 51*b*, 52*b* respectively.

The switching element 51*a* becomes a switching control element of the valve opening coil 12, and its collector is connected to the terminal 35, and its emitter is connected to the ground 54 of the battery power source 53. Its base inputs a control signal from the engine control unit (hereinafter referred to as "ECU") 55 (refer to FIGS. 5 and 6).

The switching element 52*a* mainly becomes an energizing control element of the holding coil 13, and its collector is connected through the diode 50 for reverse current inhibiting to the terminal 37, and its emitter is connected to the ground 54 of the battery power source 53. The diode 50 for reverse current inhibiting may be provided between the drive circuit 52 and the ground 54. Its base inputs a control signal from the ECU 55.

Here, a specific example of energizing control of the coils 12, 13 will be explained with reference to FIG. 5 and FIG. 7.

Figure 7:
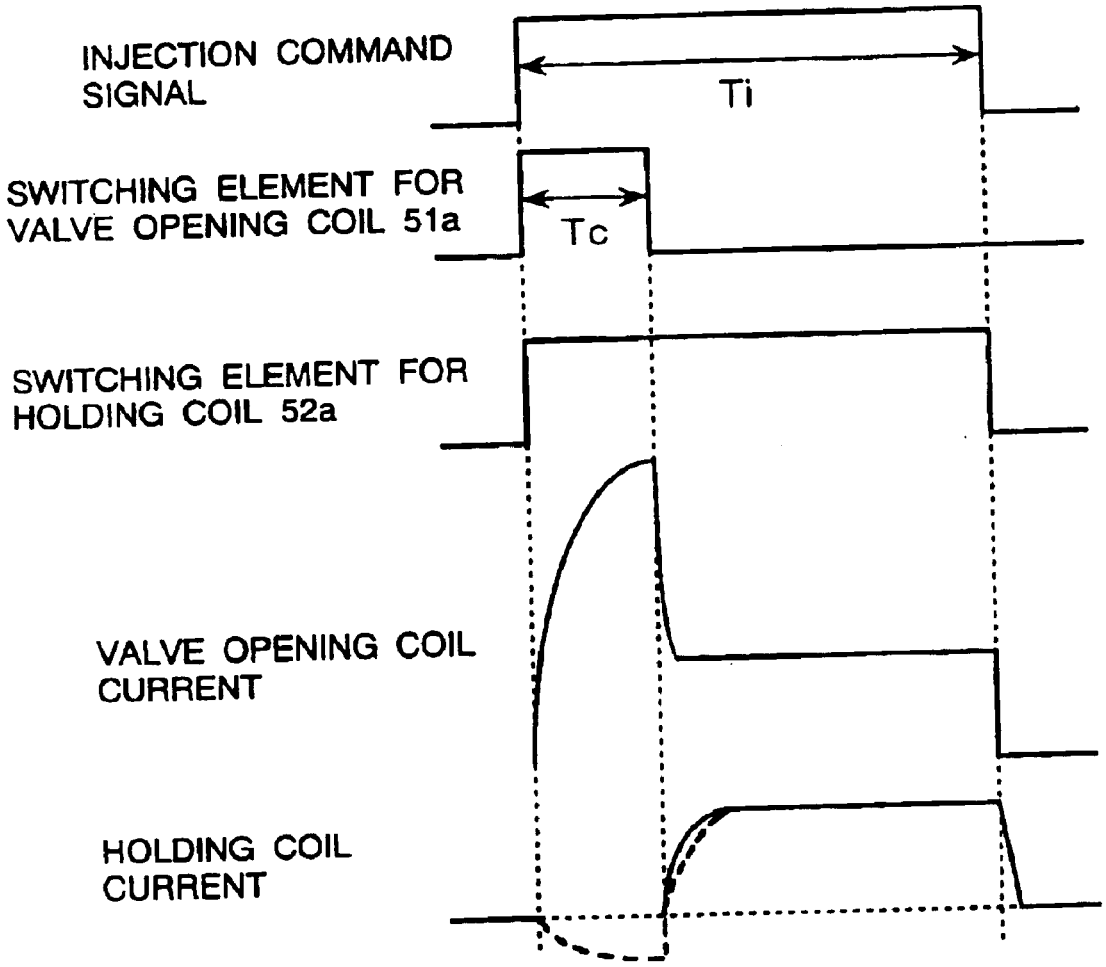
FIG. 7 is a time chart showing coil energizing control of an injector in the embodiment.
Figure 8A:
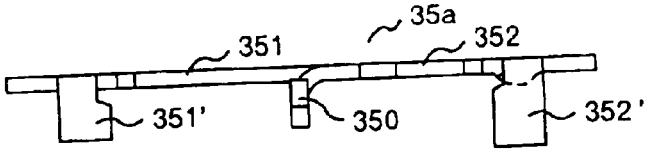
FIG. 8 is a six-face view showing an example of a coil terminal to be used in the embodiment.
Figure 8C:
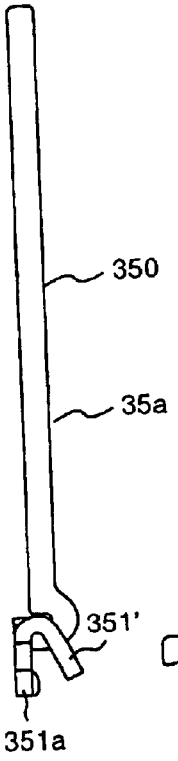
Figure 8B:
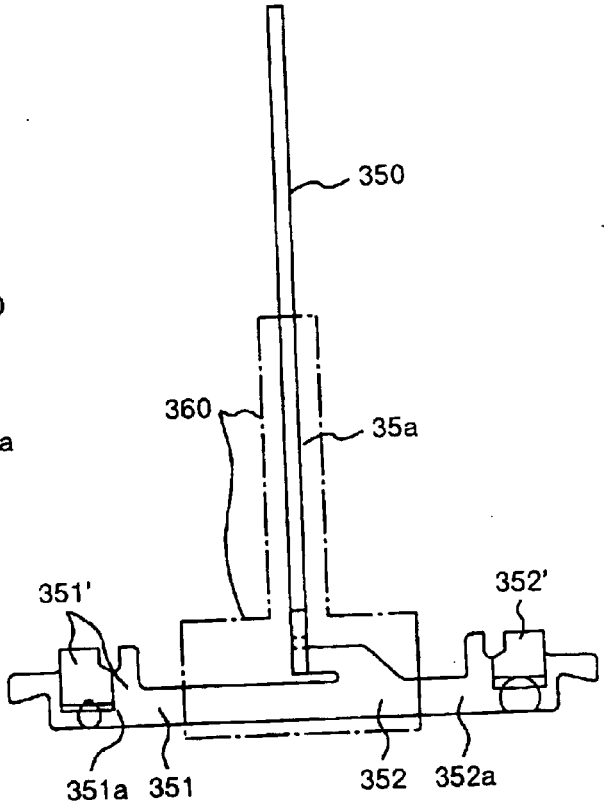
Figure 8D:
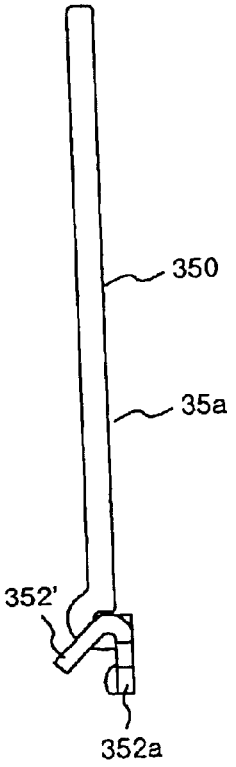
Figure 8E:
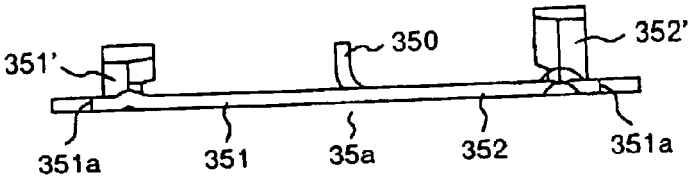

FIG. 7 is a time chart during the valve opening operation of the injector 100, and shows wave forms of an injection command signal, a switching element for a valve opening coil, a switching element for a holding coil, a valve opening coil current and a holding coil current.

If the injection command signal in response to a state of the engine is operated by the ECU 55, the switching element 52*a* is ON-controlled only in the same time Ti as the injection command signal. On the other hand, the switching element 5*a* is ON-controlled only in the short time Tc from the output start of the injection command signal. Accordingly, during the time Tc, any of the valve opening coil 12 and the holding coil 13 becomes an energizing state. However, the coil resistance is larger in the coil 13 than in the side of the coil 12. Therefore the almost current flows from the valve opening coil 12 to the side of the switching element 51*a*.

In the valve opening coil 12, since the coil resistance and the inductance are small, a large current flows rapidly. Therefore the magnetomotive force necessary for the valve opening operation is generated with good response. That is, the valve opening coil 12 has characteristics that the time variation rate (rise) of the magnetomotive force is large. The energizing time for the current to flow in the coil 12 is limited to a short time until the valve opening operation, and moreover the number of turns is little. Thus the heating can be suppressed.

During the time Tc, the mutual induction phenomenon by the mutual inductance is produced between the valve opening coil 12 and the holding coil 13. Thus when the valve opening coil 12 rises largely, the electromotive force in the reverse direction is generated in the holding coil 13.

When such electromotive force is generated, if there is no diode 50, it follows that the reverse current as shown by broken line in FIG. 7 flows from the side of the ground 54 through the surge absorbing diode 52*b* in the holding coil 13. The reverse current produces a magnetic flux in the holding coil 13. However, the magnetic flux is produced in the direction that a magnetic flux generated in the valve opening coil 12 is decreased. If the reverse current is allowed, the produced magnetomotive force substantially during the valve opening will be decreased. In order to avoid this, as shown in FIG. 5, the diode 50 for reverse current preventing is provided between the terminal 37 and the ground 54.

After the time Tc (after the valve opening), the switching element 51*a* is turned off and the switching element 52*a* continues the ON-state. Thus the valve opening coil 12 and the holding coil 13 are connected in series. Therefore the same current flows in the coils 12, 13. The current value becomes the value that the battery voltage is divided by the sum of the resistance values in the coils 12, 13. The number of turns and the resistance of the holding coil 13 arte further larger than that of the valve opening coil 12. Thus the coil current is determined substantially by the resistance of the holding coil 13. In the time from Tc to Ti, current flows in the holding coil 13 having the number of turns relatively much and the magnetomotive force becomes large, and current flows also in the valve opening coil 12 having the number of turns relatively little. In such constitution, in comparison with the case that a current flows in the holding coil 13 only, the large magnetomotive force can be obtained in total. In addition, such coil constitution and energizing control can be realized in the direct injection system without using the booster circuit and the current control circuit. Thus such constitution is advantageous in the cost, and also has the high speed response property. Therefore the present applicants already propose such constitution as the prior patent application (JP-A 11-100972).

In order to provide the above-mentioned characteristics, in the embodiment, the wire diameter of the valve opening coil 12 is made relatively large, for example, about ϕ0.45–ϕ0.65 mm, and the number of turns is made 40 turns, and the inner resistance is made about 0.13 Ω. Also the wire diameter of the holding coil 13 is made, for example, about ϕ0.15 mm, and the number of turns is made 135 turns, and the inner resistance is made about 5.5 Ω.

Figure 1B:
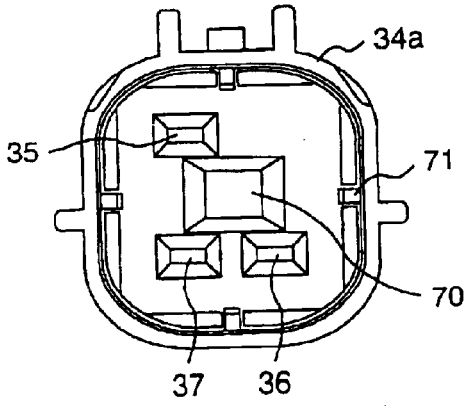
Figure 2:
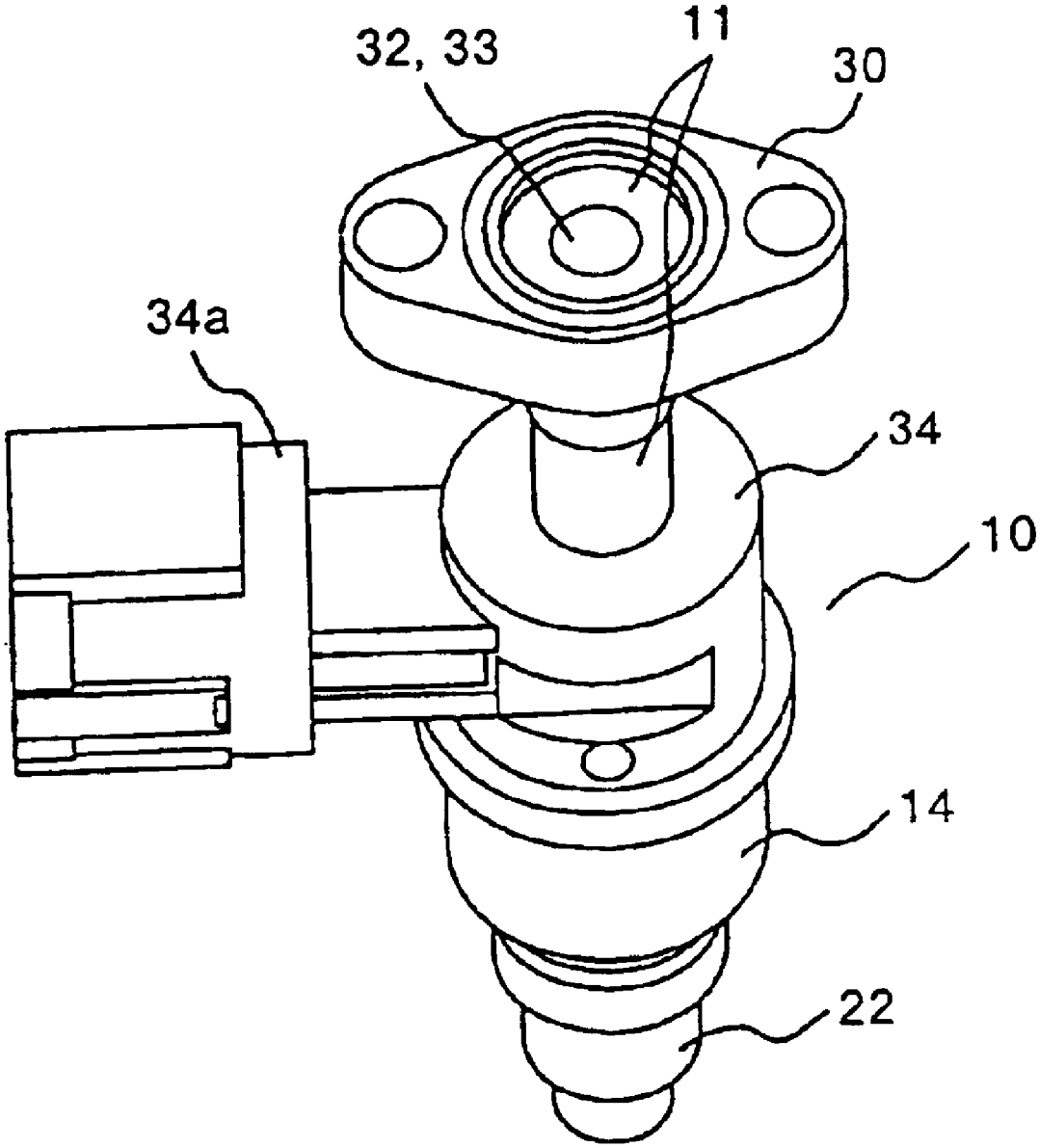
FIG. 2 is a perspective view of the injector.

The coils 12, 13 are arranged separately in the axial direction on one bobbin 15 as shown in FIG. 1, and the valve opening coil 12 is near the movable unit 19 in comparison with the holding coil 13. In such constitution, during the valve opening operation, magnetic flux produced in the coil 12 can pass through the movable core 19' and the stationary core 11 with a little loss, and the rising characteristics of the valve opening operation become better.

When the current flowing in the electromagnetic coil becomes large as above described, amount of heat generated increases. Therefore the heat radiation measure becomes necessary. Accordingly, the bobbin 15 is constituted by a synthetic resin containing a filler having good heat conductivity.

In the embodiment, as a synthetic resin material of the bobbin 15, PPS excellent in the heat resisting property is adopted, and iron oxide as a filler having good heat conductivity is contained in the PPS. For example, the PPS is in 60 and several weight %-10 and several weight %, and the iron oxide is in 30–80 weight %, and a glass fiber is in several weight %-10 and several weight %. Regarding the PPS, any of bridging type or straight chain type may be used. In the case of straight chain type, it is excellent in impact resisting property and welding strength. The PPS has the heat conductivity being 0.4 W/mk, and PA (polyacetal) resin in 6-nylon series widely used in such a bobbin in the prior art has the heat conductivity being about 0.2–0.3 W/mk. Accordingly the PPS resin has the good heat conductivity of the resin material itself in comparison with the bobbin resin in the prior art. When the iron oxide in 30 weight % is contained in the PPS resin, the heat conductivity becomes 1 W/mk. Also when the iron oxide in 80 weight % is contained in the PPS resin, the heat conductivity becomes 3 W/mk. However, if the filler is contained in 80 weight % or more, a difficulty is produced in the molding. Thus the upper limit of the filler content is preferably less than this value.

The present inventors have made an article on an experimental basis and performed the estimation test of the article in the case that normal working in twenty years was supposed and the upper limit value of the heat resisting temperature of the coil film was made 242° C.

An example of the test results is shown Table 1 below.

TABLE 1

| | Specification | | | | | | | | Temperature rise (° C.) (Duty 40%) | |
|---|---|---|---|---|---|---|---|---|---|---|
| | Holding coil | | | Valve opening coil | | | | Between core and bobbin | | |
| No. | Wire diameter | Turns | Resistance | Wire diameter | Turns | Resistance | Bobbin material | | No fuel | With fuel |
| 1 | ϕ 0.15 | 90 | 4.0 Ω | ϕ 0.65 | 40 | 0.13 Ω | PPS 0.4 w/mk | Contact | 238.5 | — |
| 2 | ϕ 0.15 | 90 | 3.7 Ω | ϕ 0.65 | 40 | 0.13 Ω | PPS + good heat conducting filler 3 w/mk | Pad | 100.7 | 85.9 |
| 3 | ϕ 0.15 | 90 | 3.7 Ω | ϕ 0.65 | 40 | 0.13 Ω | PPS + good heat conducting filler 1 w/mk | Conductive adhesive | 132.5 | 124.6 |
| 4 | ϕ 0.15 | 180 | 7.7 Ω | ϕ 0.65 | 40 | 0.13 Ω | PPS + good heat conducting filler 3 w/mk | Contact | 44.9 | 39.1 |
| 5 | ϕ | 180 | 7.7 | ϕ | 40 | 0.13 | PPS + | Conduc- | 80.4 | 68.2 |

TABLE 1-continued

| | Specification | | | | | | | | Temperature rise (° C.) (Duty 40%) | |
|---|---|---|---|---|---|---|---|---|---|---|
| | Holding coil | | | Valve opening coil | | | | Between | | |
| No. | Wire diameter | Turns | Resistance | Wire diameter | Turns | Resistance | Bobbin material | core and bobbin | No fuel | With fuel |
| | 0.15 | | Ω | 0.65 | | Ω | good heat conducting filler 1 w/mk | tive adhesive | | |
| 6 | ϕ 0.15 | 180 | 7.7 Ω | ϕ 0.65 | 40 | 0.13 Ω | PPS + good heat conducting filler 1 w/mk | Contact | 106.0 | 97.2 |
| 7 | ϕ 0.15 | 135 | 5.5 Ω | ϕ 0.65 | 40 | 0.13 Ω | PPS + good heat conducting filler 1 w/mk | Contact | 127.2 | 127.2 |
| 8 | ϕ 0.15 | 90 | 3.7 Ω | ϕ 0.65 | 30 | 0.09 Ω | PPS + good heat conducting filler 3 w/mk | Contact | 128.9 | 128.9 |

In the experiment, the duty of the injection driving was made 40 percent, and the injector was driven under the environment temperature being the normal temperature (20° C.), and the coil temperature was measured. In the table, the area between the core and the bobbin means mode between the outer circumference of the stationary core 11 and the inner circumference of the bobbin 15, and the "contact" means the case that both the core 11 and the bobbin 15 are contacted in the close contact state, and the "conductive adhesive" means that both as above described are adhered with the adhesive having the heat conductivity, and the "pad" means that the heat conductive material is filled between both as above described.

Also item "temperature rise" in the table is divided into "no fuel" and "with fuel". The "no fuel" means that assuming the gasification of the fuel within stationary core 11, the injector is driven in the state of no fuel and the temperature rise of the coil is measured. The state that the fuel within core 11 is gasified, means the case that when the inside of the engine room is at the high temperature environment of, for example, about 130° C. (when the temperature is high as in the midsummer, the high load working performed continuously, and then immediately after the engine is stopped, such high temperature state is produced) and also the injector is at the stop state, such gasified state is produced.

The "with fuel" means the case that the fuel is in the liquefied state within the stationary core 11. The injector according to No. 1 means an injector according to the comparative example where a glass fiber is contained in the PPS resin as a bobbin. In the injector according to No. 2 or later, the filler of good heat conductivity (iron oxide, here) is contained in the PPS resin as a bobbin (however, a glass fiber filler is contained in several weight % ten and several weight %). Among them, the heat conductivity being 3 W/mk is the case that the containing ratio of the filler of good heat conductivity is 80 weight %, and the heat conductivity being 1 W/mk is the case that the containing ratio of the filler of good heat conductivity is about 30 weight %.

As a result of the endurance test, in the case of No. 1, in the environment of the normal temperature (20° C.) and "no fuel", the coil temperature rises to 238.5° C. In the case that the inside of the engine room is at the high temperature environment (130° C.), it is supposed that the coil temperature is further rises by 110° C. (130° C.−20° C.). Accordingly when the inside of the engine room is at the violent high temperature environment, the coil temperature becomes (238.5° C.+110° C.), and this entirely exceeds the heat resisting temperature 242° C. of the coil film.

On the contrary, in the case of the injector at No. 2 or later, the heat radiation characteristics of the coil temperature is improved by the bobbin. Therefore the coil temperature remains about 132.5° C. at most, even in the case of "no fuel" at the environment of the normal temperature. Accordingly even if the inside of the engine room is at the violent high temperature environment, the coil temperature is about (132.5° C.+110° C.). Except for the case of No. 3, the result is obtained that the coil temperature is less than the coil film resisting temperature 242° C. The heating of the coil in this case is radiated from the bobbin 15 through the core 11 and the yoke 14.

Among them, considering the molding property of the bobbin, the coil resistance and the aspect of the cost, that of No. 7 is at good balance synthetically. Therefore according to the embodiment, even if the coil heating temperature rises by the coil exciting current being large accompanied by the improvement of the performance of the injector, the excellent heat radiation performance can be exhibited and the long life of the injector can be secured.

In addition, in place of the direct injection system (DI system), in the injection in the system that a fuel is injected at the suction passage, the coil current does not become larger as in the DI system. Therefore in the case, even at the injection specification of No. 1 (the heat conductivity of the bobbin being 0.4 W/mk) in the above-mentioned table, the heat radiation performance can be raised in comparison with the injector of similar type until now.

Further in the embodiment, in addition to the heat radiating property of the coil, the bobbin structure is adopted where parts can be arranged at intensive method rationally.

Regarding the bobbin 15, as shown in FIG. 1, the step difference of the outer diameter is provided so that the bobbin outer diameter in the region with the holding coil 13 wound thereon is smaller than the bobbin outer diameter in the region with the valve opening coil 12 wound thereon. On the other hand, the bobbin inner diameter in the region with the valve opening coil 12 wound thereon has the step difference of the inner diameter 153 where a part of the inner diameter becomes large, in order to secure the annular space S for the interposing of the seal ring 18 of the non-magnetic property.

In such constitution, the seal ring 18 can be installed between the outer circumference at the top end of the stationary core 11 and the inner bottom of the yoke 14 in the state that the bobbin inner space S is utilized effectively. Moreover the bobbin is thinned at the position with the seal ring 18 existing and at the position with the holding coil 13 existing and thereby the heat of the electromagnetic coils 12, 13 can be escaped to the side of the core 11 efficiently (a part of the heat can be escaped through the seal ring 18 to the core 11 and the yoke 14).

Particularly when the heat of the coils 12, 13 is conducted through the bobbin 15 having good heat conductivity to the core 11 and the yoke 14 as in the embodiment, even if a gap between the most outside in the coil and the yoke 14 remains as it is, the sufficient heat radiation of the coil is assured. Also since the gap remains as it is, the cost reduction is intended, and moreover the gap can be utilized as the insulation gap layer between the coil and the yoke.

In addition, in the seal ring 18, one end side (upper part side) is coupled by the metal flow, and the lower end side is in edge shape and is cut into the yoke bottom part.

Thus it seals between the coil 11 and the yoke 14.

According to the bobbin structure, the injector is excellent in the heat radiating property of the coils 12, 13, and moreover the electromagnetic coil part and the seal part are made intensive and the injector is made compact.

Next, the arrangement structure of the coil terminal will be explained.

In the coil terminal of the embodiment, the three-terminal structure is adopted as already described. Any of the three terminals is arranged at the upper end surface of the bobbin 15. In coil terminals of the embodiment, three-terminal-structure is adopted as already described. Any of the three terminals is arranged on the upper end surface of the bobbin 15. Among them, the terminals 36, 37 are arranged on the axial line o of the main body of the injector, in other words, on the position near the connector part 34*a* with respect to the core 11. The terminal 35 is arranged in that the base part 35*a* is on the opposite position to the connector part 34*a*. The terminal 35 is hidden in the shadow of the core 11 viewing from the side of the connector part 34*a*. Accordingly when the terminal 35 is to be led to the side of the connector part 34*a* straightforward, the core 11 obstructs its path. Therefore in the embodiment, regarding the terminal 35, a curved part 35' is formed from the base part 35*a* at the midway led to the connector part 34*a*, so as to avoid the axial line hence the core 11.

In the embodiment, considering the workability of the terminal 35, the terminal 35 is divided into a base part 35*a* and a lead frame 35*b*, and the lead frame 35*b* is welded to the base part 35*a*. In any of the terminals 35, 36, 37, one end becomes a connector terminal.

In such constitution, when a plurality of coil terminals are arranged on the bobbin end surface, the degree of freedom is raised, and moreover, three or more connector terminals (coil terminals) can be arranged on one connector in intensive method, and the injector is made compact.

The connector part 34*a* is molded integrally with the mold resin 34 constituting the upper external part of the injector. Viewing from the bobbin 15, the connector part 34*a* is projected to the lateral side of the mold resin at the upper side. In the terminals 35–37, a part except for the top end becoming the connector terminal is insert molded (embedded) in the mold resin 34.

Hereupon, the coil module to be used in the injector of the embodiment will be explained using FIG. 4 and FIG. 8.

FIGS. 8(*a*)–(e) show a top view, a front view, a left side view, a right side view and a bottom view of the base part 35*a* in the coil terminal 35. The base part 35 is formed integrally by a center pin 350 and arm parts 351, 352 stretched laterally at the lower part of the center pin 350, and is molded by the press working of a metal sheet. In the arm part 351, a part 351*a* binding the winding finishing end 12' of the valve opening coil 12 is provided (refer to FIG. 4), and in an arm part 352, a part 352*a* binding the winding start end 13' of the holding coil 13 is provided. The coil end being bound is grasped by the binding parts 351*a*, 352*a* and bending pieces 351', 352', and is joined in fusing with the bending piece.

Series connection of the valve opening coil 12 and the holding coil 13 becomes possible through the binding parts 351*a* and 352*a*, and connection to the switching element 51*a* for the value opening coil 12 as already described becomes possible.

Figure 3:
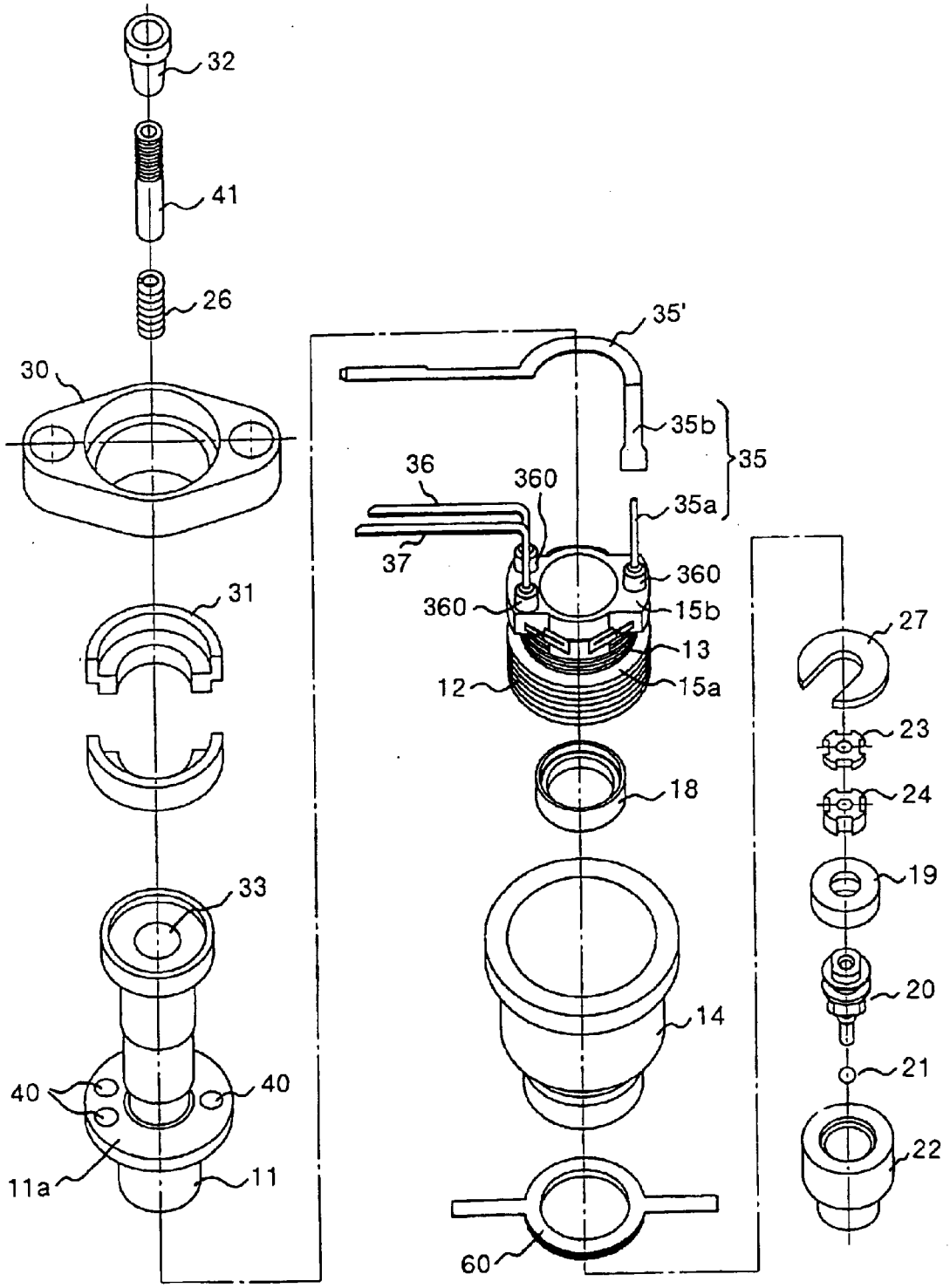
FIG. 3 is an exploded perspective view of the injector.

In the base part 35*a*, a part is coated with an insulation resin mold as shown in an imaginary line (dash-and-dot line) 360 in FIG. 8(*b*). FIGS. 1, 3 and 4 show the state that a part of the resin mold 360 is projected from the upper end of the bobbin 15. The resin mold part 360 does not contain a filler of iron oxide. The reason for applying the resin mold 360 to the base part 360 is as follows. The bobbin 15 in the embodiment has the insulation property but contains iron oxide. Thus the bobbin 15 is not always complete in the point of the insulation property. Therefore among the base part 35*a*, at least a part embedded in the bobbin 15 is coated with an insulation resin not including iron oxide and insulation of the terminal is assured.

The other terminals 36, 37 have an arm part binding one end of the coil only at one side, although not shown. According to the reason as above described, in the terminals 36, 37, at least a part embedded in the bobbin is coated with an insulation resin mold 360.

Figure 4:
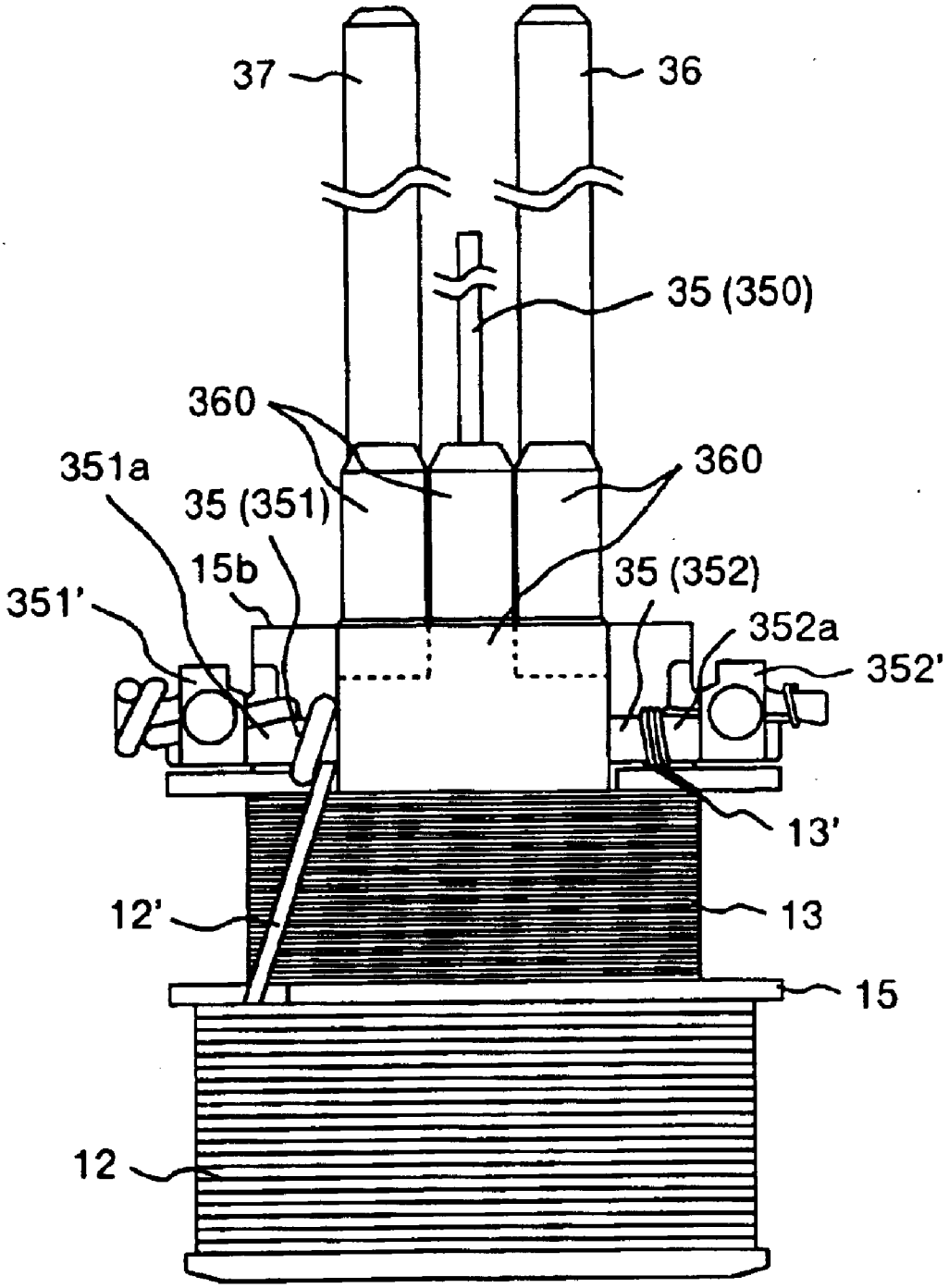
FIG. 4 is a front view showing an electromagnetic coil module to be used in the injector.

As shown in FIG. 4, the bobbin 15 is wound by the valve opening coil 12 and the holding coil 13, and the terminals 35, 36, 37 are arranged on the upper end surface. Thus the coil module is constituted.

In the arm part of each terminal from the bobbin 15, respective coil ends are bound and joined in fusing.

In FIGS. 1 and 3 numeral 23 designates a swirler pushing unit, numeral 30 designates a flange for mounting the injector, numeral 31 designates a collet, numeral 32 designates a filter, numeral 60 designates a corrugated packing, numeral 70 designates a removing part of the connector 34*a*, and numeral 71 designates a connector guide.

According to the embodiment, following effects are obtained.

(1) Heat resisting property of the bobbin 15 is improved, and moreover the heat radiating property for the coil heating is raised.

Accordingly even if the case of the electromagnetic coil having the coil characteristics where the environment temperature is violent and the heating temperature is high as in the direct injection, reliability of the coil and the bobbin is maintained and the long life of the injection can be assured.

(2) Even if two types of electromagnetic coils different in characteristics are used, three terminals of the coil module are used.

Accordingly parts are used rationally and in intensive method, and the coil module hence the injector is made compact and the cost reduction is intended.

(3) Also when the coil terminal 35 is drawn to the connector part 34*a*, the consideration is done in a part of the terminal so as to avoid the core 11. Accordingly the degree of freedom in the design of the terminal layout can be raised, and moreover three or more coil terminals are arranged on one connector in intensive method and the injector can be made compact.

In the above-mentioned embodiment, although iron oxide is exemplified as a filler of good heat conductivity to be contained in the bobbin 15, the filler of good heat conductivity is not limited to this, but otherwise ceramics with good heat conduction (for example, alumina), BN (boron nitride) or the like may be used. Such good heat conductive material may be mixed in one type or two or more types.

Further connection of the valve opening coil 12 and the holding coil 13 may be considered in various modes.

Figure 9:
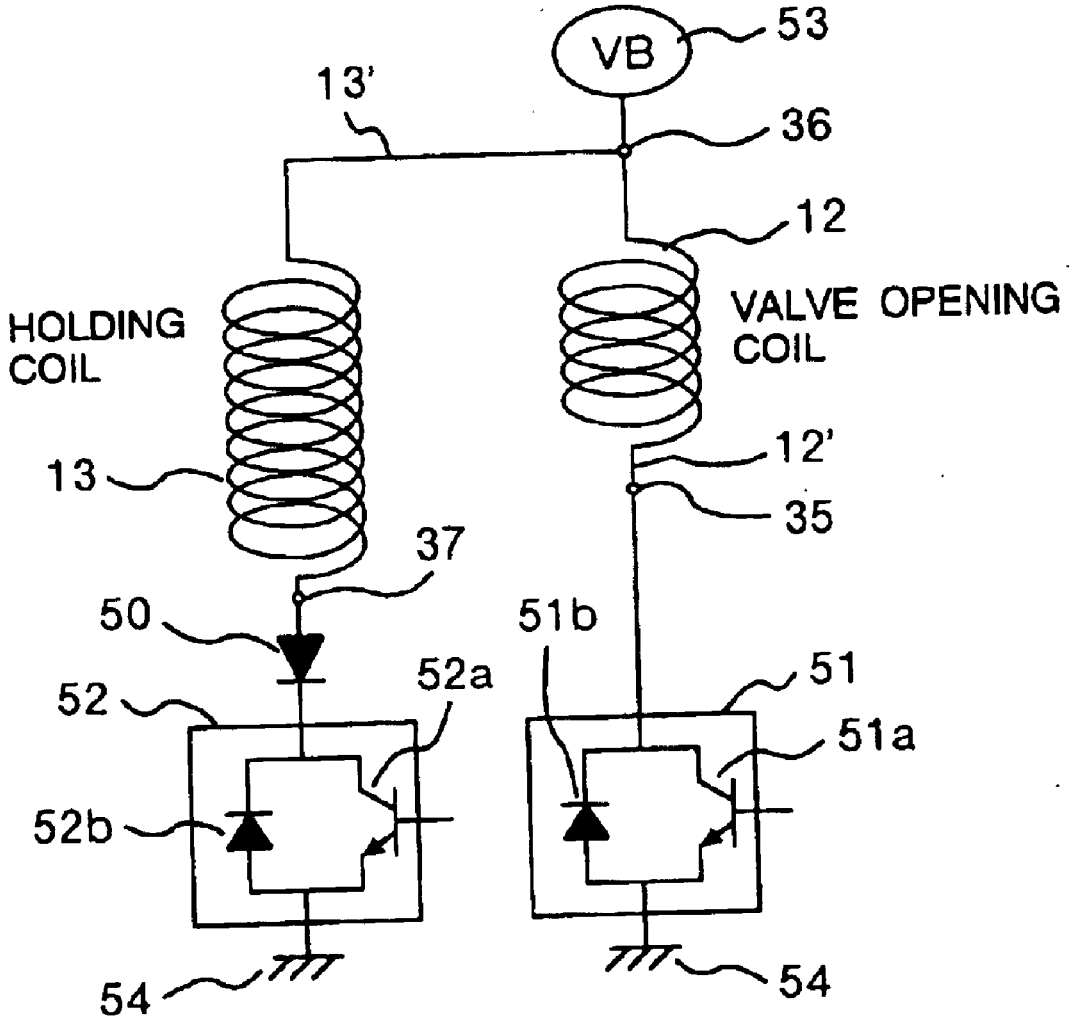
FIG. 9 is a diagram showing a coil connection mode in another embodiment of the invention.

For example, as shown in FIG. 9, in the first terminal 36, one end of the valve opening coil 12 and one end of the holding coil 13 may be connected to the plus side of the battery power source 53, and in the second terminal 35 other end of the valve opening coil 12 may be connected to the first switching element 51*a*, and in the third terminal 37, other end of the holding coil 13 may be connected to the second switching element 52*a*. In this case, the energizing control of the coil may be similar to FIG. 7. Also in the embodiment, the connector of three terminals can be realized in the injector having the valve opening coil 12 and the holding coil 13.

Figure 10:
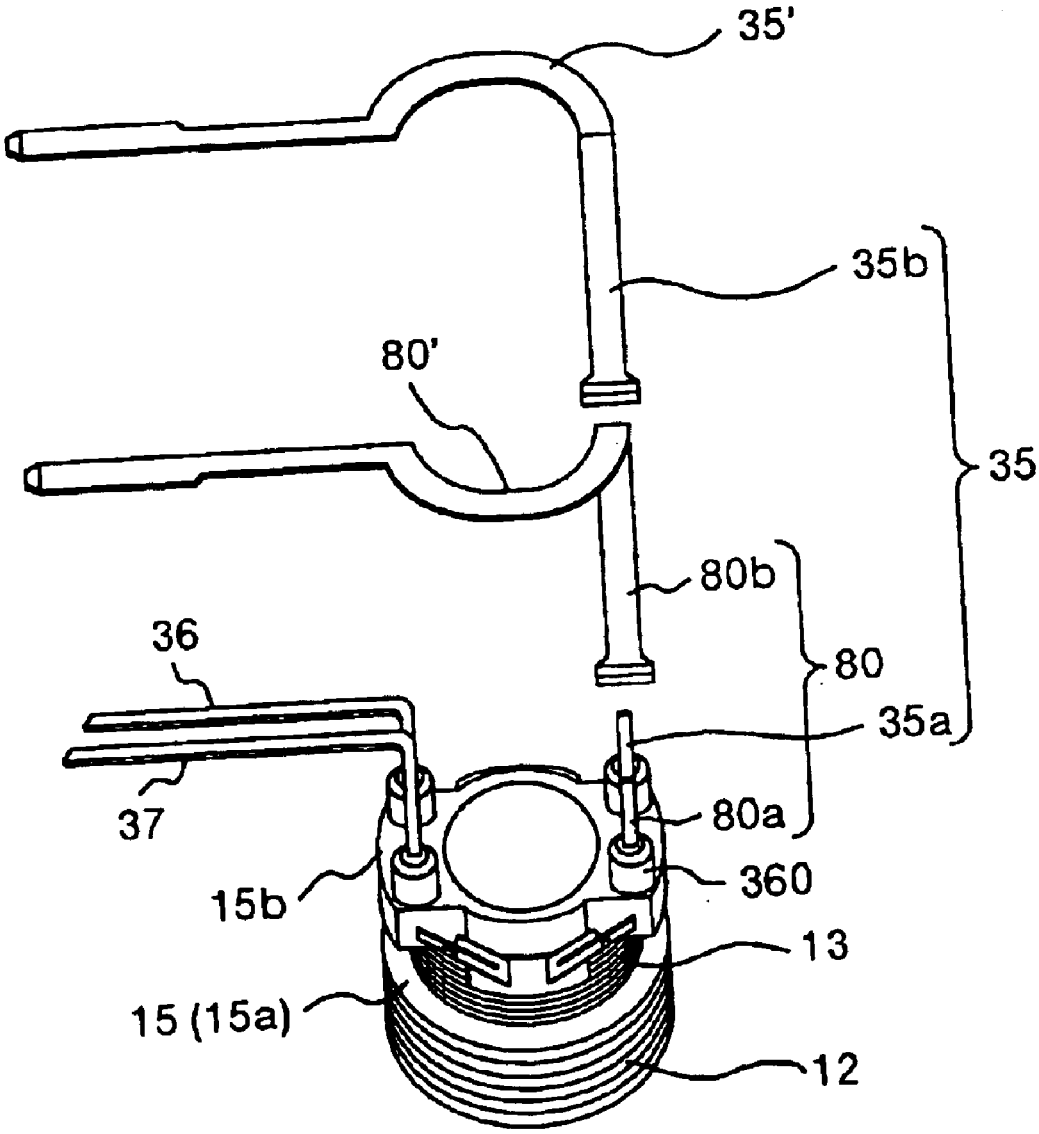
FIG. 10 is a fragmentary exploded perspective view of a coil module in another embodiment of the invention.

Further in the injector having the valve opening coil 12 and the holding coil 13, if independent terminals 35 to 37 and 80 are prepared in each coil end, four-terminal structure as shown in FIG. 10 can be adopted. Also in this case, when the terminal base part is arranged at the opposite side of the connector part with respect to the axial line of the main body of the injector, curved parts 35', 80' are formed in a part of the terminal. Thus the degree of freedom of the terminal layout and intensive use of plural terminals in one connector can be intended.

In the embodiment, the terminal 80 comprises the base part 80*a* and the lead frame 80*b*.

Industrial Applicability

According to the present invention as above described, the heat radiation property of the coil of the injector accompanied by the performance improvement is raised, and the injector can withstand the high heat environment well, and the long life of the injector is assured, moreover the injector is made compact and the cost reduction can be intended.

What is claimed is:

1. A fuel injector having a valve driven by electromagnetic force, which injects fuel directly into a cylinder of an internal combustion engine, comprising:

a first coil in which a large excitation current flows for a short time during a beginning of a valve opening operation so as to substantially secure magnetomotive force necessary to open said valve;

a second coil in which a relatively small excitation current flows so as to substantially secure magnetomotive force to hold the valve in an open state after said valve is opened; and a bobbin on which said first and second coils are wound;

wherein said bobbin with said first and second coils is formed by a resin molding material having a heat conductivity between 1.0–3.0 W/mk, and wherein said first and second coils are arranged on an axial direction of said bobbin, a flange for partitioning between said first coil and said second coil is provided at the bobbin, and said flange extends to the inner surface of a yoke housing the first and second coils.

2. The fuel injector according to claim 1, wherein said bobbin is formed by a synthetic resin containing a filler having good heat conductivity.

3. The fuel injector according to claim 1, further comprising a stationary core arranged at a center of a main body of the fuel injector, said first and second coils arranged at the outside of said stationary core through said bobbin;

a cylindrical yoke arranged at the outside of said first and second coils;

wherein said bobbin is formed by a synthetic resin containing a filler having good heat conductivity, and wherein heat of said first and second coils is conducted to said core and said yoke through said bobbin, and further an air gap is formed between the outside surface in said coil and an inner circumference of said yoke.

4. The fuel injector according to claim 1, wherein said bobbin is formed of polyphenylene sulfide containing iron oxide and/or alumina as a filler.

5. The fuel injector according to claim 1, wherein said bobbin is constituted by iron oxide and/or alumina in 30–80 weight %, and further by polyphenylene sulfide and glass fiber.

6. The fuel injector according to claim 1, wherein said fuel injector is a battery-type injector driven by supplying a battery voltage to said first and second coils directly.

* * * * *